US006726543B1

(12) United States Patent
Klosterman

(10) Patent No.: US 6,726,543 B1
(45) Date of Patent: Apr. 27, 2004

(54) SKATE BLADE SHARPENING APPARATUS AND METHOD

(75) Inventor: Michael W. Klosterman, Akron, OH (US)

(73) Assignee: Klawhorn Industries, Inc., Wadsworth, OH (US)

( * ) Notice: Subject to any disclaimer, the term of this patent is extended or adjusted under 35 U.S.C. 154(b) by 0 days.

(21) Appl. No.: 10/418,650

(22) Filed: Apr. 18, 2003

(51) Int. Cl.[7] ..... B24B 1/00; B23F 21/03
(52) U.S. Cl. ..... 451/45; 451/557
(58) Field of Search ..... 451/45, 555, 558, 451/523, 524, 557; 76/83, 82, 88

(56) References Cited

U.S. PATENT DOCUMENTS

| | | | | |
|---|---|---|---|---|
| 1,006,000 A | | 10/1911 | Oosdyke | |
| 3,585,880 A | | 6/1971 | Kabriel | |
| 3,921,341 A | * | 11/1975 | Thompson | 451/558 |
| 5,189,845 A | * | 3/1993 | Courchesne | 451/557 |
| 5,195,277 A | * | 3/1993 | Courchesne | 451/58 |
| 5,445,050 A | * | 8/1995 | Owens | 76/83 |
| 5,499,556 A | * | 3/1996 | Exner et al. | 76/83 |
| 5,704,829 A | * | 1/1998 | Long | 451/558 |
| 5,916,018 A | * | 6/1999 | Watt | 451/555 |
| 6,030,283 A | | 2/2000 | Anderson | |

OTHER PUBLICATIONS

Publication, "Never A Dull Moment With SkateMate", by Tim Parr, Published http://www.skatemate.com/addressus-.html, published prior to Oct. 29, 2002.

* cited by examiner

*Primary Examiner*—Dung Van Nguyen
(74) *Attorney, Agent, or Firm*—Tarolli, Sundheim, Covell & Tummino L.L.P.

(57) ABSTRACT

An apparatus for use in sharpening a skate blade includes a handle and a cartridge connected to one end of the handle. The cartridge includes a casing and a sharpening blade. The sharpening blade has an arcuate cutting edge with a radius of curvature which corresponds to a radius of hollow of a skate blade to be sharpened. The casing at least partially defines a slot which has a thickness which corresponds to a thickness of the skate blade to be sharpened. The arcuate cutting edge on the sharpening blade extends across the bottom of the slot.

50 Claims, 3 Drawing Sheets

SKATE BLADE SHARPENING APPARATUS AND METHOD

BACKGROUND OF THE INVENTION

The present invention relates to a new and improved apparatus and method for use in sharpening a skate blade having a thickness and radius of hollow.

A known skate blade sharpening apparatus includes a hand held housing which encloses a cylindrical abrasive member, that is, a honing stone. A slot is provided in the housing to position the blade of a skate relative to the honing stone. A skate blade sharpening apparatus having this construction is disclosed in U.S. Pat. No. 6,030,283.

Another skate blade sharpening apparatus includes a manually engagable body or housing having a slot which receives a skate blade. Carbide cutting inserts are disposed in the housing and are engaged by a skate blade when the blade is disposed in the slot. A skate blade sharpening apparatus having this construction is disclosed in U.S. Pat. No. 3,585,880.

Still another known skate blade sharpening apparatus includes a file and a body of abrasive material. A first slot is provided to position the skate blade relative to the file. A second slot is provided to position the skate blade relative to the abrasive material. A skate blade sharpening apparatus having this construction is disclosed in U.S. Pat. No. 1,006,000.

SUMMARY OF THE INVENTION

The present invention relates to a new and improved apparatus and method for use in sharpening a skate blade. The apparatus may include a handle and a sharpening cartridge which is connected with the handle. The sharpening cartridge may include a casing and a sharpening blade which is connected with the casing. A slot may be formed in the casing and is engagable with opposite sides of a skate blade to position the skate blade and sharpening apparatus relative to each other. The sharpening blade may have an arcuate cutting edge which extends across the bottom of the slot in the casing. The arcuate cutting edge is engagable with the skate blade during sharpening of the skate blade.

A plurality of sharpening cartridges may be provided to sharpen skate blades having different dimensions. The thickness of a skate blade to be sharpened may be gauged. A sharpening cartridge having a slot with a width corresponding to the gauged width of the skate blade is then selected. The selected sharpening cartridge is connected with the handle and is utilized to sharpen the skate blade.

The present invention has a plurality of different features. The different features of the present invention may be used either separately or in combination with each other or in combination with features of the prior art. It should be understood that various combinations of features of the present invention and/or features of the prior art may be combined to provide a skate blade sharpening apparatus.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
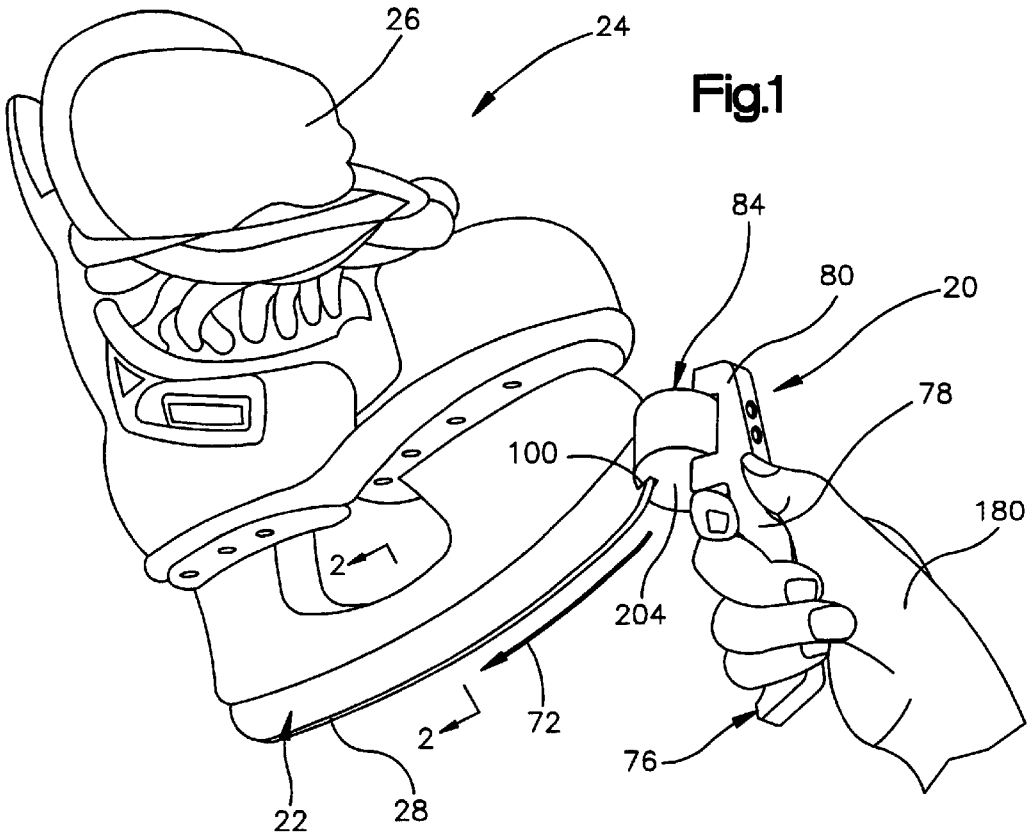
FIG. 1. is a schematic pictorial illustration depicting the manner in which a skate blade sharpening apparatus constructed in accordance with the present invention is utilized to sharpen a skate blade.

The use of a skate blade sharpening apparatus 20 to sharpen a runner or blade 22 of an ice skate 24 is illustrated schematically in FIG. 1. The ice skate 24 includes a shoe 26 which is connected to the skate blade 22 in a known manner. It should be understood that the ice skate 24 is representative of many different known types of skates including hockey skates, figure skates, and speed skates.

The skate blade 22 is relatively thin and has a long narrow edge 28 which is sharpened. The blade edge 28 has a longitudinally extending groove with a relatively small radius of hollow. Thus, the skate blade 22 has parallel major side surfaces 30 and 32 (FIG. 2) which are separated by relatively small distance. Therefore, the skate blade 22 has a relatively small thickness, indicated by an arrow 34 in FIG. 2.

The sharpened edge 28 of the skate blade 22 has a minor side surface 36 which extends between the major side surfaces 30 and 32 of the skate blade 22. The minor side surface 36 of the skate blade is hollow to provide a groove, which may be referred to as a radius of hollow, along the center of the skate blade 22. By forming the hollow or groove in the minor side surface 36 of the skate blade 22, an inside edge 38 and an outside edge 40 are formed on the bottom of the skate blade 22. The skate blade 22 has a relatively small radius of hollow, as indicated by an arrow 44 in FIG. 2. The radius of hollow 44 is the distance from the center of curvature of the arcuate bottom surface 36 to the bottom surface.

Figure 3:
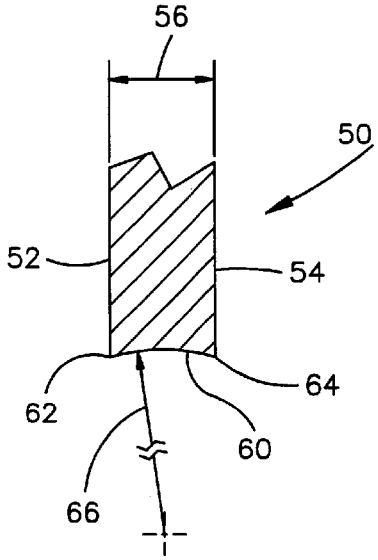
FIG. 3. is a fragmentary schematic sectional view, generally similar to FIG. 2 of a portion of a skate blade having a greater thickness than the skate blade of FIG. 2 and a larger radius of hollow than the skate blade of FIG. 2.

A second skate blade 50 is illustrated schematically in FIG. 3. The skate blade 50 is connected with the shoe of an ice skate in the same manner as is indicated schematically in FIG. 1 for the skate blade 22. The skate blade 50 differs from the skate blade 22 in that it is thicker and has a greater radius of hollow. Since the skate blade 50 has a greater radius of hollow, it will, generally speaking, tend to have less bite into the ice. However, the greater radius of hollow of the skate blade 50 will tend to make it easier for the skater to glide on the ice with exertion of less energy than with the skate blade 22.

The skate blade 50 has major side surfaces 52 and 54 which are spaced apart by a relatively large distance, compared to the distance between the major side surfaces 30 and 32 of the skate blade 22. Therefore, the skate blade 50 has a greater thickness, indicated by an arrow 56 in FIG. 3.

A minor side surface 60 of the skate blade 50 extends between the major side surfaces 52 and 54. Inside and outside edges 62 and 64 are formed at the intersection of the arcuate minor side surface 60 and the major side surfaces 52 and 54 of the skate blade 50. The skate blade 50 has a relatively large radius of hollow, indicated by an arrow 66 in FIG. 3. The radius of hollow 66 is the distance from the center of curvature to the bottom side surface 60 of the sharpened edge of the skate blade 50.

The thickness 34 and 56 of the skate blades 22 and 50 may be any one of a substantial number of thickness. Thus, the thickness of skate blades may vary between 2.7 and 3.1 millimeters in 0.25 millimeters increments. It should be understood that the foregoing specific dimensions for the thicknesses 34 and 56 of the skate blades 22 and 50 have been set forth herein for purposes of clarity of the description and not for purposes of limitation of the invention. It is contemplated that the skate blades 22 and 50 may have any desired thickness within a large range of thicknesses.

Similarly, the radiuses of hollow 44 and 66 of the skate blades 22 and 50 may vary within a large range of radiuses of hollow. For example, the radiuses of hollow may vary between $\frac{3}{8}^{th}$ of an inch and 1¼ of an inch in eighth inch increments. It should be understood that a greater range of radiuses of hollow may be provided on skate blades and that they may vary within increments which are smaller than one eighth of an inch. Although the relatively thin skate blade 22 has been illustrated schematically in FIG. 2 as having a relatively small radius of hollow 44 and the relatively thick skate blade 50 has been illustrated schematically in FIG. 3 as having a relatively large radius of hollow, a thin skate blade 22 may have a large radius of hollow and a thick blade 50 may have a small radius of hollow.

A particular skater may wish to have one radius of hollow on a blade 22 or 50 when skating on one type of ice and a different radius of hollow on the same blade when skating on a different type of ice. Other skaters may wish to maintain a constant radius of hollow on a blade 22 or 50 during skating on different types of ice. Regardless of whether a particular skater prefers to maintain the radius of hollow of a particular blade 22 or 50 constant, the skater will occasionally want to sharpen the blade.

The improved sharpening apparatus 20 constructed in accordance with the present invention is manually moved along the edge 28 of the skate blade 22 in the manner indicated schematically by an arrow 72 in FIG. 1. Although the sharpening apparatus 20 is illustrated in FIG. 1 as being manually moved along the edge 28 of the skate blade 22 to sharpen the blade, the skate blade may be moved relatively to the sharpening apparatus if desired. It is contemplated that there may be a combination of movement of the sharpening apparatus 20 along the skate blade 22 and movement of the skate blade 22 relative to the sharpening apparatus 20 during sharpening of the skate blade.

The sharpening apparatus 20 includes a base 76. The base 76 has a handle 78 and mounting portion 80. A sharpening cartridge 84 is constructed in accordance with the present invention and is fixedly connected to the mounting portion 80 of the base 76. The sharpening cartridge 84 may be supplied separately from the base 76.

When the sharpening apparatus is to be utilized, the handle 78 may be manually grasped, in the manner illustrated schematically in FIG. 1. The sharpening cartridge 84 is positioned in engagement with the blade 22 on the ice skate 24. The sharpening apparatus 20 is then moved along the skate blade 22 in the manner indicated by the arrow 72 while the skate blade 22 engages the sharpening cartridge 84.

Figure 6:
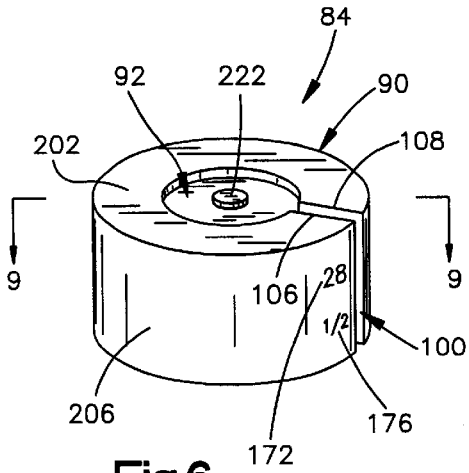
FIG. 6. is a schematic pictorial illustration of a sharpening cartridge, constructed in accordance with the present invention, to sharpen a relatively thin skate blade having a relatively small radius of hollow, similar to the skate blade of FIG. 2.
Figure 9:
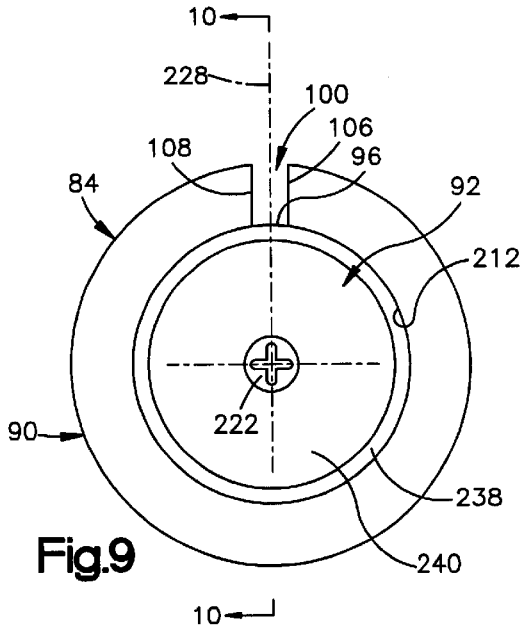
FIG. 9 is a plan view, taken generally along the line 9–9 of FIG. 6, illustrating the construction of a sharpening blade and casing of the sharpening cartridge.
Figure 10:
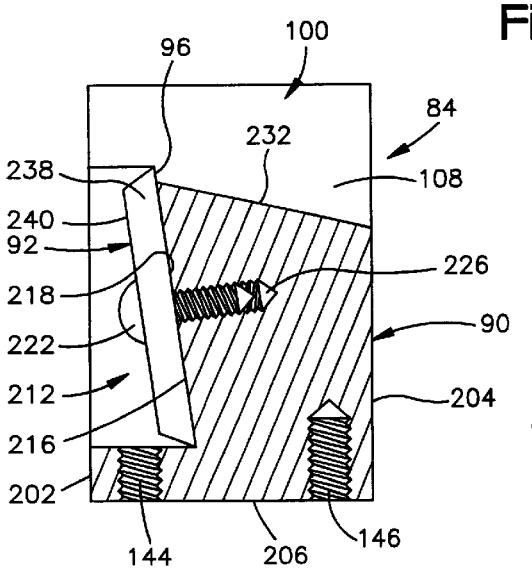
FIG. 10 is a schematic sectional view, taken generally along the line 10–10 of FIG. 9, further illustrating the relationship between the casing and the sharpening blade in the sharpening cartridge.

The sharpening cartridge 84 has a generally cylindrical configuration (FIG. 6) and includes a casing 90 which encloses a sharpening blade 92. The sharpening blade 92 has an arcuate cutting edge (FIG. 10). The arcuate cutting edge 96 extends across the bottom of a slot 100 formed in the casing 90 (FIGS. 6, 9 and 10). The cutting edge 96 forms a chip by fracturing or shearing the material of the skate blade 22 during sharpening of the edge 28. The sharpening blade 92 does not grind the edge 28 of the skate blade 22.

Figure 2:
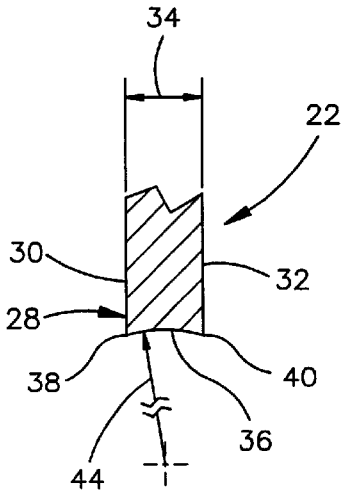
FIG. 2. is a fragmentary sectional view, taken generally along the line 2—2 of FIG. 1, illustrating the thickness and radius of hollow of the skate blade.

The slot 100 has a width which corresponds to the thickness of the blade 22 of a skate 24 to be sharpened with the sharpening apparatus 20 (FIG. 1). The width of the slot 100 is only slightly greater than the thickness 34 of the blade 22 (FIG. 2). Therefore, flat parallel opposite sides 106 and 108 (FIGS. 6 and 9) of the slot 100 are effective to engage the flat parallel opposite sides 30 and 32 (FIG. 2) of the skate blade to position the skate blade 22 relative to the sharpening blade 92 in the cartridge 84.

The arcuate cutting edge 96 (FIGS. 9 and 10) of the sharpening blade 92 has a radius of curvature which corresponds to the desired radius of hollow 44 (FIG. 2) of the of the groove in the edge 28 of the skate blade 22. Therefore, the arc of curvature of the arcuate cutting edge 96 on the sharpening blade 92 matches the desired arc of curvature of the minor side surface 36 of the skate blade 22. The arcuate cutting edge 96 of the sharpening blade 92 cuts, rather than grinds, the edge 28 of the skate blade 22 to obtain a minor side surface 36 with a concavity corresponding to the desired radius of hollow. The radius of hollow 44 of the skate blade 22 may be changed by sharpening the skate blade with a sharpening blade 92 which has a radius of curvature which is different than the existing radius of hollow of the skate blade.

The skate blade 22 is accurately positioned relative to the sharpening blade 92 by engagement with opposite side surfaces 106 and 108 of the slot 100. This results in the center of curvature of the concave arcuate minor side surface 36 (FIG. 2) of the skate blade 22 being disposed in a radial plane through the center of curvature of the arcuate cutting edge 96 (FIGS. 9 and 10) on the sharpening blade 92 during movement of the sharpening apparatus 20 along the edge 28 of the skate blade 22. During sharpening of the edge 28 of the skate blade 22, a radial plane extending through the center of curvature of the arcuate cutting edge 96 and parallel to the side surfaces 106 and 108 is disposed midway between the opposite major sides 30 and 32 of the blade 22 and midway between the side surfaces 106 and 108 of the slot 100.

Different skate blades may have different thicknesses. Thus the skate blade 50 (FIG. 3) is thicker than the skate blade 22 (FIG. 2). A sharpening cartridge 120 (FIG. 7) for the relatively thick skate blade 50 is constructed in accordance with the present invention and has the same general construction as the sharpening cartridge 84 of FIG. 6. The sharpening cartridge 120 may be supplied separately from the base 76.

The sharpening cartridge 120 includes a casing 124 which at least partially encloses a sharpening blade 126. The casing 124 has a slot 130. The slot 130 has flat parallel opposite side surfaces 132 and 134 which engage opposite major side surfaces 52 and 54 on the skate blade 50 (FIG. 3) to position the skate blade relative to the sharpening cartridge 120. Thus, the width of the slot 130 corresponds to the thickness 56 of the skate blade 50.

The sharpening blade 126 (FIG. 7) has a cutting edge with an arc of curvature which corresponds to the desired radius of hollow 66 of the skate blade 50 (FIG. 3). Therefore, the convex cutting edge on the sharpening blade 126 matches the desired concavity of the minor side surface 60 on the skate blade 50. By having the radius of hollow 66 correspond to the arc of curvature of the edge on the sharpening blade 126, the sharpening cartridge 120 can be utilized to sharpen the skate blade 50 without changing the radius 66 of hollow of the skate blade. The radius 66 of hollow of the skate blade 50 may be changed by sharpening the skate blade with a sharpening blade 126 having a radius of curvature which is different than the existing radius of hollow.

When the sharpening cartridge 120 (FIG. 7) is to be utilized to sharpen the skate blade 50 (FIG. 3), the sharpening cartridge is connected with the base 76 (FIGS. 4 and 5) of the sharpening apparatus 20. To connect the sharpening cartridge 120 with the base 76, the sharpening cartridge 84 must first be disconnected from the base. To disconnect the sharpening cartridge 84 from the base 76, a pair of fasteners 140 and 142 (FIG. 5) are disengaged from the sharpening cartridge 84.

The fasteners 140 and 142 are threaded screws which extend through the mounting portion 80 of the base 76 into engagement with threaded openings 144 and 146 (FIG. 10) in the sharpening cartridge 84. Thus, the fastener 140 (FIG. 5) engages the threaded opening 144 in the sharpening cartridge 84 while the fastener 142 engages the threaded opening 146 in the sharpening cartridge 84. Although threaded fasteners are utilized to connect the sharpening cartridge 84 with the base 76, it is contemplated that the sharpening cartridge 84 may be connected with the base in a different manner. For example, a clamp assembly may be provided on the base to grip the sharpening cartridge 84.

When the sharpening cartridge 84 has been disconnected from the base 76, the sharpening cartridge 120 (FIG. 7) is connected to the base. To connect the sharpening cartridge 120 with the base 76, the threaded fasteners 140 and 142 (FIG. 5) are inserted through the mounting portion 80 of the base 76 into engagement with internally threaded openings, corresponding to the openings 144 and 146 of FIG. 10, in the sharpening cartridge 120.

The slot 130 (FIG. 7) in the sharpening cartridge 120 is then aligned with the skate blade 50. The sharpening cartridge 120 is then moved along the concave minor side surface 60 (FIG. 3) of the skate blade 50. The manner in which the sharpening cartridge 120 is moved along the skate blade 50 is the same as is illustrated schematically in FIG. 1.

As the sharpening cartridge 120 is moved along the skate blade 50, opposite side surfaces 132 and 134 (FIG. 7) of the slot 130 engage opposite major side surfaces 52 and 54 (FIG. 3) of the skate blade 50 to center the sharpening blade 126 relatively to the minor side surface 60 of the skate blade 50. This results in the center of curvature of a cutting edge on the sharpening blade 126 being coincident with the center of the desired radius of hollow 66 of the minor side surface 60 of the skate blade. Therefore, a concave groove formed in the minor side surface 60 of skate blade 50 is centered between opposite major side surfaces 52 and 54 of the skate blade.

It is contemplated that the radius of hollow of the skate blades 22 and/or 50 may be changed during sharpening. Thus, by using a sharpening blade having a cutting edge with a larger radius of curvature than the radius of hollow 44 (FIG. 2) for the skate blade 22, the radius of hollow of the skate blade 22 may be increased from the relative small radius of hollow illustrated in FIG. 2. Similarly, by using a sharpening blade 126 (FIG. 7) having a cutting edge with a radius of curvature which is smaller than the radius of hollow 66 (FIG. 3) of the skate blade 50, the radius of hollow of the skate blade 50 may be decreased during sharpening of the skate blade. Of course, the sharpening blade may be selected to match the existing radius of hollow of a skate blade 22 or 50 to enable the skate blade to be sharpened without changing the radius of hollow.

Figure 8:
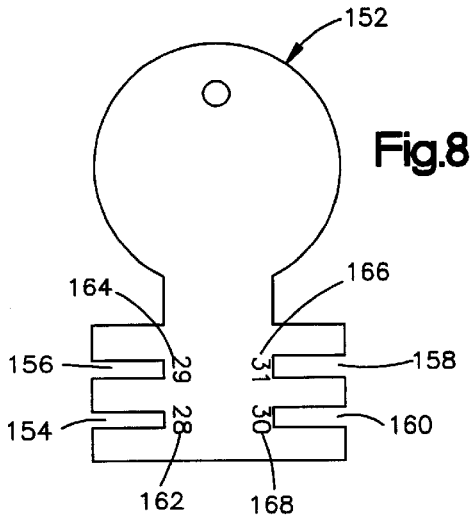
FIG. 8. is a schematic plan view of one specific skate blade thickness gauge.

A gauge 152 (FIG. 8) may be utilized to determine the thickness of a skate blade. The gauge 152 has a plurality of slots 154, 156, 158 and 160 which have different widths. Indicia 162, 164, 166, and 168 is provided adjacent to the slots 154–160 to indicate the widths of the slots. Thus, the indicia 162 indicates that the slot 154 has a width of 2.9 millimeters. Similarly, the indicia 166 indicates that the slot 158 has a width of 3.1 millimeters. Rather than using numerical indicia which indicates the width of the slots 154–160 in the gauge 152, alphabetical indicia which does not indicate the width of the slots may be utilized if desired.

The sharpening cartridges are provided with similar indicia 172 and 174 (FIGS. 6 and 7) to indicate the corresponding size of the slots 100 and 130 in the sharpening cartridges 84 and 120. Thus, the relatively narrow slot 100 (FIG. 6) in the sharpening cartridge 84 has indicia 172 which indicates that it corresponds to a blade width of 2.8 millimeters. This is the same as the width of the slot 154 (FIG. 8) in the gauge 152. Similarly, the indicia 174 (FIG. 7) on the sharpening cartridge 170 indicates that the slot 130 has a width corresponding to the width of the slot 158 (FIG. 8) in the gauge 152. If alphabetical symbols were utilized rather than numerical symbols to indicate the width of the slot on the gauge 152, alphabetical symbols would also be utilized to indicate the width of the slots on the sharpening cartridges 84 and 120.

The sharpening cartridges 84 and 120 (FIGS. 6 and 7) are provided with indicia 176 and 178 to indicate the arc of curvature of the sharpening blades 92 and 126. Thus, the relatively small sharpening blade 92 (FIG. 6) has a relatively small radius of hollow corresponding to the indicia 176. Similarly, the relatively large sharpening blade 126 has a relatively large radius of hollow corresponding to the indicia 178. If desired, alphabetical symbols may be utilized to indicate the radius of curvature of the blades 92 and 126.

Figure 7:
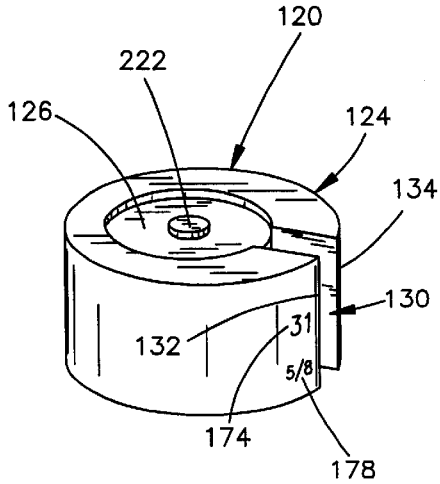
FIG. 7. is a schematic pictorial illustration of a sharpening cartridge, constructed in accordance with the present invention, to sharpen a relatively thick skate blade having a relatively large radius of hollow, similar to the skate blade of FIG. 3.

Although only two sharpening cartridges 84 and 120 have been illustrated in FIGS. 6 and 7, it is contemplated that a greater number of sharpening cartridges will be provided. For example, four sharpening cartridges having slots with widths corresponding to the widths of each of the slots 154–160 on the gauge 152 may be provided. Of course, a plurality of gauges with different size slots or a greater number of slots may be utilized to gauge the thickness of skate blades. If this was done, the number of sharpening cartridges provided would correspond to the number of different widths of skate blades indicated by the gauges. It is contemplated that the gauge 152 may have a construction which is different than the specific construction illustrated in FIG. 2.

It is contemplated that sharpening cartridges 84 or 120 having sharpening blades 92 or 126 with different radiuses of curvature may be used to sharpen a skate blade 22. Therefore, after determining the width of a skate blade 22 to be sharpened, a person who intends to the sharpen the skate blade would select a sharpening cartridge having a slot 100 or 130 corresponding to the skate blade width and a sharpening blade 92 or 126 having a radius of curvature corresponding to the desired skate blade radius of hollow.

When a skate blade, for example the skate blade 22 is to be sharpened, the gauge 152 is utilized to determine the thickness of the skate blade 22. The specific skate blade 22 illustrated in FIG. 2 has a thickness, indicated by the arrow 34, of approximately 2.8 millimeters. Therefore, a person utilizing the gauge 152 (FIG. 8) would find that the slot 154 would fit over the skate blade 22 with very little tolerance. The person desiring to sharpen the skate blade 22 would note that the indicia 162 indicates that the skate blade had a width of 2.8 millimeters. The person utilizing the sharpening apparatus 20 would then select the cartridge 84 having indicia 172 corresponding to the indicia 162. The selected cartridge 84 would also have indicia 176 corresponding to the desired radius of hollow.

The selected cartridge 84 would then be connected with the base 76 with the threaded fasteners 140 and 142. Once the sharpening cartridge 84 has been connected with the mounting portion 80 of the base 76, in the manner illustrated in FIGS. 4 and 5, the sharpening apparatus 20 would be utilized to sharpen the blade 22 on the skate 24.

If an individual is desirous of sharpening a skate having a blade 50 (FIG. 3), the individual would find that the blade would not fit into the slot 154 (FIG. 8) of the gauge 152. However, the skate blade 50 would fit into the slot 158 of the gauge 152 with little or no tolerance. Therefore, the individual would select the sharpening cartridge 120 (FIG. 7) having indicia 174 which corresponds to the indicia 166 adjacent to the slot 158 in the gauge 152. The selected sharpening cartridge 120 would have indicia 178 corresponding to the desired radius of hollow. The sharpening cartridge 120 would then be connected to the mounting portion 80 of the base 76 with the threaded fasteners 140 and 142.

It should be understood that although only two sharpening cartridges 84 and 120 have been illustrated in FIGS. 6 and 7, a greater number of sharpening cartridges may be utilized in association with the base 76. For example, a person having a relatively large number of skates with different blade thicknesses may have a sharpening cartridge for each of the blade thicknesses. In addition, if an individual has blades with the same thicknesses and different radiuses of hollow, sharpening cartridges would be provided for each of the radiuses of hollow.

An individual may wish to change the radius of hollow of a skate blade by sharpening a skate blade with a cartridge having a sharpening blade with a cutting edge having an arc of curvature corresponding to the desired radius of hollow. By selecting a sharpening cartridge with a sharpening blade having a cutting edge with a small radius of curvature, the radius of hollow of a skate blade may be changed from a relatively large radius of hollow to a relatively small radius of hollow. Similarly, by selecting a sharpening cartridge with a sharpening blade having a relatively large radius of curvature, a radius of hollow of a skate blade may be changed from a relatively small radius of hollow to a relatively large radius of hollow by sharpening the skate blade. Of course, the radius of hollow may be maintained constant during sharpening of a skate blade.

Base

The base 76 of the sharpening apparatus 20 (FIGS. 4 and 5) includes a longitudinally extending handle 78. The handle 78 is provided with a plurality of recesses or grooves in which the fingers on the hand 180 (FIG. 1) of a person utilizing the sharpening apparatus are received. The mounting portion 80 (FIGS. 4 and 5) is connected to one end of the handle 78. The mounting portion 80 may be offset from the handle 78 to provide space between the bottom or minor side surface 36 of a skate blade 22 and fingers on the hand 180 (FIG. 1) of a person using the sharpening apparatus 20.

Figure 4:
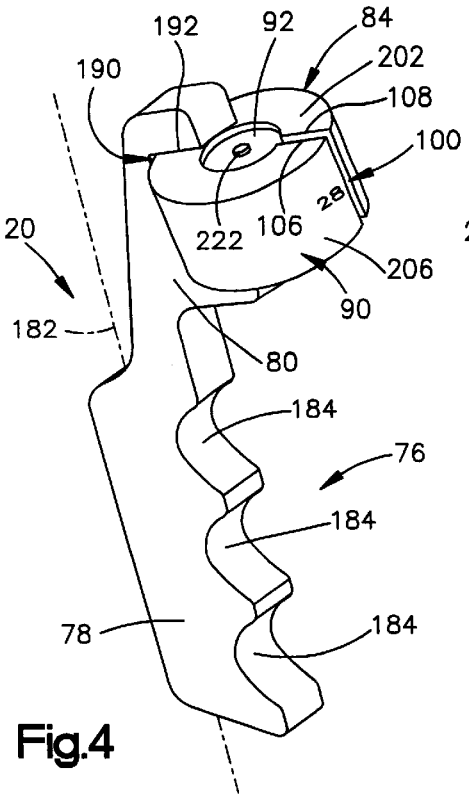
FIG. 4. is a schematic pictorial illustration depicting the relationship between a manually engagable base and a cartridge of a skate blade sharpening apparatus of FIG. 1.
Figure 5:
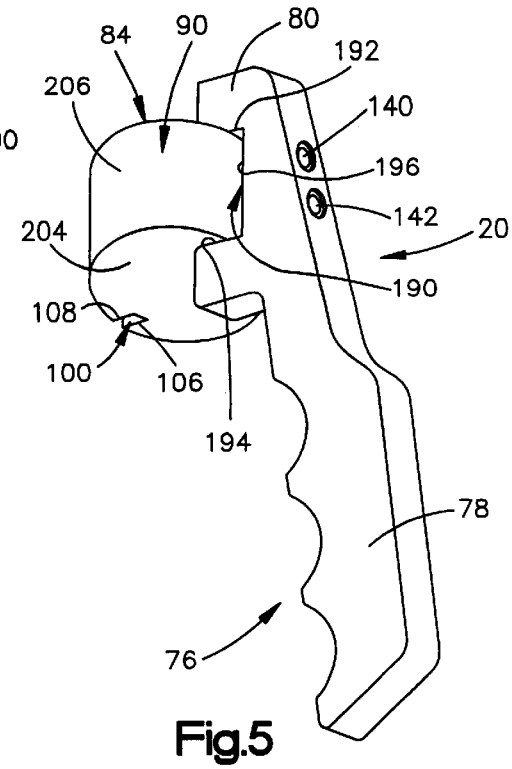
FIG. 5. is a schematic pictorial illustration further depicting the relationship between the base and cartridge of the skate blade sharpening apparatus of FIG. 4.

The handle 78 has a longitudinal central axis 182 (FIG. 4). The mounting portion 80 of the base 76 is disposed along the central axis 182 of a handle 78. However, the mounting portion 80 of the base 76 is offset to one side, that is towards the right as viewed in FIG. 4, from the central axis 182 of the handle 78. Of course, if desired, the mounting portion 80 may be configured such that the central axis 182 of the handle 78 would extend through the mounting portion. By having the mounting portion offset from the central axis 182 of the handle 78, in the manner illustrated in FIG. 4, the fingers on the hand 180 of a person utilizing the sharpening apparatus 20 are spaced a substantial distance from a skate blade 22 during movement of the sharpening apparatus 20 along the skate blade, in the manner indicated by the arrow 72 in FIG. 1.

The handle 78 and mounting portion 80 of the base 76 (FIGS. 4 and 5) are integrally formed as one piece of metal. Although the base 76 of the sharpening apparatus 20 may be formed of many different materials, the specific base 76 described herein is formed of aluminum having a hard anodized code. Specifically, the base 76 is formed of MILL-A-8625 Type III. Of course, the base 76 may be formed of other metals, for example steel, if desired.

The mounting portion 80 of the base 76 is provided with a rectangular recess 190 in which sharpening cartridges are received. The recess 190 includes a pair of flat parallel end surfaces 192 and 194 (FIGS. 4 and 5) which engage opposite ends of the sharpening cartridges. Although the sharpening cartridges have different size slots 100 or 130 (FIGS. 6 and 7) and different size sharpening blades 92 or 126, the sharpening cartridges all have the same axial extent. Therefore, regardless of the width or radius of curvature of the skate blade to be sharpened with a sharpening cartridge, the sharpening cartridge is securely held in the recess 190 in the mounting portion 180 of the base 76.

The recess 190 in the mounting portion 80 of the base 76 has a flat bottom surface 196 (FIG. 5) which engages a longitudinal side of a sharpening cartridge. The threaded fasteners 140 and 142 extend through the bottom surface 196 of the recess 190 into engagement with a selected sharpening cartridge to be held in place on the base 76. The selected sharpening cartridge is securely held by the recess 190 and the fasteners 140 and 142 so that the sharpening cartridge can not move relative to the base 76 during sharpening of a skate blade.

Sharpening Cartridge

The sharpening cartridge 84 (FIG. 6) has a generally cylindrical configuration. However, it is contemplated that the sharpening cartridge 84 could have a different configuration if desired. For example, the sharpening cartridge 84 may have a generally polygonal configuration.

The sharpening cartridge 84 includes the cylindrical casing 90 which firmly supports the sharpening blade 92 and at least partially encloses the sharpening blade. The base 90 has a circular front end surface 202 (FIG. 10) and a circular rear end surface 204 which are disposed in a coaxial relationship and extend parallel to each other. When the sharpening cartridge 84 is positioned in the recess 190 (FIG. 5) in the mounting portion 80 of the base 76, the flat end surface 192 of the recess is disposed in engagement with the front end surface 202 of the sharpening cartridge 84. Similarly, the end surface 194 of the recess 190 is disposed in engagement with the rear end surface 204 of a casing 90.

The casing 90 has a cylindrical outer side surface 206 which extends between the front and rear end surfaces 202 and 204 (FIGS. 4 and 10). The cylindrical side surface 206 of the casing 90 is disposed in engagement with the bottom surface 196 (FIG. 5) of the recess 190 in the mounting portion 80 of the base 76. Tightening of the threaded fasteners 140 and 142 pulls the cylindrical outer side surface of the casing 90 firmly against the bottom surface 196 of the recess 190.

The recess 190 is sized so that there is a tight fit of the casing 90 in the recess. This results in the casing 90 being securely attached to the base 76 by the threaded fasteners 140 and 142. When the casing 90 is secured to the base 76 by the fasteners 140 and 142, the casing cannot move relative to the base 76.

The illustrated sharpening blade 92 has a circular configuration (FIG. 9). This results in the arcuate cutting edge 96 of the sharpening blade 92 being circular. However, the sharpening blade 92 may have a different configuration if desired.

A recess 212 (FIG. 10) is formed in the casing 90 to receive the sharpening blade 92. The illustrated sharpening blade 92 has a circular configuration. Therefore, the recess 212 has a cylindrical configuration. However, if the sharpening blade has a different configuration, the recess 212 may also have a different configuration.

For example, the sharpening blade 92 may have a polygonal configuration and the recess 212 may have a polygonal configuration. Alternatively, the sharpening blade 92 may be formed with arcuate segments. The arcuate segments may be provided on opposite sides of the sharpening blade. If desired, a series of arcuate segments may be arranged in a circular array about the periphery of the sharpening blade. The arcuate segments may have the same radius of curvature or may have different radiuses of curvature so as to correspond to different radiuses of hollow. The recess 212 may have a configuration corresponding to the peripheral configuration of the sharpening blade or a configuration which is different from the configuration of the sharpening blade.

In the embodiment of the casing 90 illustrated in FIGS. 9 and 10, the recess 212 has a flat circular bottom surface 216 (FIG. 10) which is engaged by a flat circular major side surface 218 of the sharpening blade 92. The bottom surface 216 of the recess 212 is skewed at an acute angle to a central axis of the casing 90. The bottom surface 216 of the recess 212 slopes from the slot 100 in a direction away from the open end of the recess 212, that is, in a direction toward the back end surface 204 of the casing 90.

The fastener 222 extends through the sharpening blade 92 and into engagement with a threaded opening 226 in the casing 90. The central axis of the threaded opening 226 extends perpendicular to the bottom surface 216 of the recess 212 and is skewed at an acute angle relative to the central axis of the casing 90. When the fastener 222 is tightened, the flat major side surface 218 on the sharpening blade 92 is pressed firmly against the bottom surface 216 of the recess 212. This results in the sharpening blade 92 being securely held so that it cannot vibrate relative to the casing 90 during sharpening of a skate blade.

In order to enable the side surfaces 106 and 108 (FIG. 9) of the slot 100 to have an extent sufficient to guide and orient the sharpening cartridge 84 relative to the skate blade, the recess 212 is offset from the central axis of the casing 90 in a direction away from the slot 100. This enables the slot 100 to be relatively deep and the side surfaces 106 and 108 to have a relatively large radial extent. By maximizing the radial extent of the side surfaces 106 and 108 of the slot 100, the extent of engagement of the side surfaces 106 and 108 of the slot with the side surfaces 30 and 32 (FIG. 2) of the skate blade 20 tends to be maximized.

The slot 100 has a central axis 228 (FIG. 9) which extends perpendicular to and intersects a central axis of the casing 90. The axis 228 is disposed midway between the side surfaces 106 and 108 of the slot 100 and is disposed in a plane which contains a radius of the sharpening blade 92 and the center of curvature of the arcuate cutting edge 96. By having a radial plane through the cutting edge 96 extend through the center of the slot 100 (FIG. 9), the center of curvature of the minor side surface 36 (FIG. 2) of the blade 22 is disposed midway between parallel planes containing the major side surfaces 30 and 32 of the blade 22 when a sharpening operation is completed. This results in the groove or hollow formed by the minor side surface 36 being centered between the major side surfaces 30 and 32 of the skate blade 22. By having the groove or hollow centered between the major side surfaces 30 and 32, the inner and outer edges 38 and 40 of the blade 22 are aligned in a plane which is tangent to the edge 28 of the blade 22 and which extends perpendicular to the side surfaces 30 and 32.

The slot 100 has a bottom surface 232 (FIG. 10) which slopes away from the arcuate cutting edge 96 on the sharpening blade 92 toward the back end surface 204 of the casing 90. The bottom surface 232 of the slot 100 also slopes downward (as viewed in FIG. 10) away from the arcuate cutting edge 96 toward the central axis of the casing 90 and towards the central axis of the sharpening blade 92. The central axis of the sharpening blade 92 extends through the center of curvature of the arcuate cutting edge 96.

When the cartridge 84 is being utilized to sharpen the skate blade 22, the bottom of the skate blade engages the bottom surface 232 of the slot 100 adjacent to the end surface 204 of the casing 90. This orients the edge 28 of the skate blade 22 longitudinally relative to the sharpening blade 92. The arcuate cutting edge 96 projects upward (as viewed in FIG. 10) from the bottom surface 232 of the slot 100 throughout the transverse extent of the bottom surface. This results in the arcuate cutting edge 96 being exposed between the side surfaces 106 and 108 at the bottom of the slot 100. The edge 28 of the skate blade 22 engages the exposed portion of the cutting edge 96.

When the skate blade 22 is being sharpened, the cartridge 84 is moved toward the right (as viewed in FIG. 10) relative to the skate blade. This results in the arcuate cutting edge 96 being pulled rightward (as viewed in FIG. 10) along the bottom of the skate blade to sharpen the skate blade. As the cutting edge 96 is pulled along the bottom of the skate blade, small chips are formed by a cutting action between the sharpening edge 96 and the skate blade 22. The skate blade 22 is sharpened with a cutting action rather than a grinding action.

The sharpening blade 92 has a minor side surface 238 which is formed as a frustrum of a right circular cone having a central axis coincident with a central axis of the circular sharpening blade 92. The minor side surface 238 extends between flat parallel circular major side surfaces 218 and 240 on the sharpening blade 92. The frustoconical configuration of the minor side surface 238 of the sharpening blade 92 results in the sharpening blade having a back cut or rake angle of approximately eight degrees. Thus, the included angle between the minor side surface 238 and the flat major side surface 218 of the sharpening blade 92 is approximately eighty-two degrees. Of course, a different rake angle may be provided if desired.

The arcuate cutting edge 96 is circular in configuration. Therefore, when the portion of the arcuate cutting edge 96 which spans the bottom of the slot 100 becomes dull, it is merely necessary to loosen the fastener 222 and to rotate the sharpening blade 92 about its central axis to move the portion of the arcuate cutting edge which has become dull out of the slot 100. As this occurs, a sharp portion of the arcuate cutting edge 96, that is, a portion of the arcuate cutting edge which has not been utilize to sharpen a skate, is moved into position spanning the bottom of the slot 100. The fastener 222 is then tightened to firmly press the sharpening blade 92 against the bottom surface 216 of the recess 212 to lock the blade in place with the new portion of the arcuate cutting edge 96 extending across the bottom of the slot 100. As was previously mentioned, the arcuate cutting edge 96 may not be formed as a portion of a circle.

In order to enhance the durability of the sharpening blade 92, the sharpening blade is formed of carbide. If desired, the sharpening blade may be formed of micro carbon carbide. Of course, the cutting blade 92 may be formed of other known materials having a hardness sufficient to sharpen the skate blade 22.

Since the side surfaces 106 and 108 of the slot 100 engage opposite major side surfaces 30 and 32 (FIG. 2) of the skate blade 22 during sharpening of the skate blade, the side surfaces 106 and 108 of the casing 90 are effective to polish the sides 30 and 32 of the skate blade 22 and to remove any burrs which may form adjacent to the inside and outside edges 38 and 40 of the skate blade. Although the casing 90 may be formed of many different materials, it is contemplated that the casing 90 may advantageously be formed of a harden aluminum.

Noncircular Sharpening Blade

Figure 11:
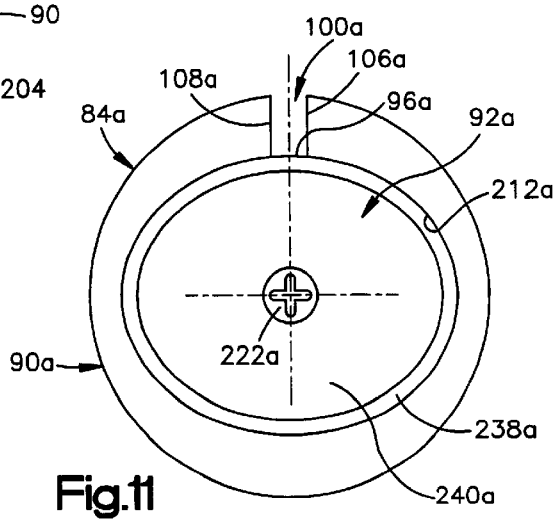
FIG. 11 is a plan view, similar to FIG. 9, of a sharpening blade having a noncircular configuration.

In the embodiments of the invention illustrated in FIGS. 1–10, the sharpening blade 92 has a circular configuration. In the embodiment of the invention illustrated in FIG. 11, the sharpening blade has a noncircular configuration. Since the embodiment of the invention illustrated in FIG. 11 is generally similar to the embodiments of the invention illustrated in FIGS. 1–10, similar numerals will be utilized to designate similar components, the suffix letter "a" being added to the numerals of FIG. 11 to avoid confusion.

A cylindrical sharpening cartridge 84*a* has a casing 90*a* with a noncircular recess 212*a* in which a noncircular sharpening blade 92*a* is disposed. The sharpening blade 92*a* is held against movement relative to the casing 90*a* by a fastener 222*a*. The sharpening blade 92*a* has a minor side surface 238*a* which extends between a flat front major side surface 240*a* and a flat rear major side surface corresponding to the major side surface 218 of FIG. 10. The minor side surface 238*a* is skewed relative to the front and rear major side surfaces so that the sharpening blade 92*a* has a back cut or rake angle of approximately eight degrees. Of course, a different rake angle may be provided if desired.

The sharpening blade 92*a* has an arcuate cutting edge 96*a*. The arcuate cutting edge 96*a* extends across the bottom of a slot 100*a* formed in the casing 90*a* (FIG. 11). The cutting edge 96*a* forms a chip by fracturing or shearing the material of the skate blade during sharpening of the blade in the manner previously described in conjunction with the embodiments of the invention illustrated in FIGS. 1–10.

The width of the slot 100*a* is only slightly greater than the thickness of a skate blade. Therefore, flat parallel opposite sides 106*a* and 108*a* of the slot 100*a* are effective to engage opposite sides of the skate blade to position the skate blade relative to the sharpening blade 92*a* in the cartridge 84*a*.

In accordance with a feature of the embodiment of the invention illustrated in FIG. 11, the sharpening blade 92*a* has an oval configuration. When a portion of the cutting edge 96*a* exposed at the slot 100*a* becomes dull, the fastener 222*a* is loosened and the sharpening blade 92*a* is rotated through 180 degrees relative to the casing 90*a*. This moves the portion of the cutting edge 96*a* which is disposed adjacent to the lower portion of the casing 90*a* in FIG. 11 into alignment with the slot 100*a*.

Although the illustrated noncircular sharpening blade 92*a* has an oval configuration, it is contemplated that the sharpening blade 92*a* may have a different configuration if desired. For example, the sharpening blade 92*a* may have a polygonal configuration. If the sharpening blade 92*a* was formed with a polygonal configuration, the recess 212*a* in the casing 90*a* would have a corresponding polygonal configuration. It is contemplated that a polygonal sharpening blade may be incrementally rotated to move one linear portion of a sharpening edge on the blade out of alignment with the slot 100*a* and to move a next adjacent portion of the cutting edge on the sharpening blade into alignment with the slot.

Conclusion

The present invention relates to a new and improved apparatus 20 and method for use in sharpening a skate blade. The apparatus 20 may include a handle 78 and a sharpening cartridge 84 which is connected with the handle. The sharpening cartridge 84 may include a casing 90 and a sharpening blade 92 which is connected with the casing. A slot 100 may be formed in the casing 90 and is engagable with opposite sides 30 and 32 of a skate blade 22 to position the skate blade and sharpening apparatus relative to each other. The sharpening blade 92 may have an arcuate cutting edge 96 which extends across the bottom 232 of the slot 100 in the casing 90. The arcuate cutting edge 96 is engagable with the skate blade during sharpening of the skate blade.

A plurality of sharpening cartridges may be provided to sharpen skate blades having different dimensions. The thickness 34 of a skate blade to be sharpened may be gauged. A sharpening cartridge 84 having a slot 100 with a width corresponding to the gauged width of the skate blade is then selected. This sharpening cartridge 84 is connected with the handle 78 and is utilized to sharpen the skate blade.

The present invention has a plurality of different features. The different features of the present invention may be used either separately or in combination with each other or in combination with features of the prior art. It should be understood that various combinations of features of the present invention and/or features of the prior art may be combined to provide a skate blade sharpening apparatus.

Having described the invention, the following is claimed:

1. A sharpening apparatus for use in sharpening a skate blade having a thickness and radius of hollow, said sharpening apparatus comprising a base having a mounting portion and a longitudinally extending handle which extends longitudinally from said mounting portion of said base, said handle having a longitudinal axis which extends along said mounting portion, and a cartridge connected to said mounting portion of said base, said cartridge includes a case having a first end which faces toward said handle and is spaced from said handle along the longitudinal axis of said handle and a second end which faces away from said handle, said cartridge further includes a sharpening blade having an arcuate cutting edge with a radius of curvature which corresponds to a desired radius of hollow of the skate blade, said case at least partially defining a slot which extends between said first and second ends of said case and has a width which corresponds to the thickness of the skate blade, said arcuate cutting edge extends across a bottom of the slot at a location between the first and second ends of said case.

2. A sharpening apparatus as set forth in claim 1 wherein said case has a cylindrical configuration.

3. A sharpening apparatus as set forth in claim 1 wherein the longitudinal axis of said handle is offset to one side of said cartridge.

4. A sharpening apparatus as set forth in claim 1 wherein said cartridge has a central axis which extends transverse to the longitudinal axis of said handle.

5. A sharpening apparatus as set forth in claim 1 wherein said sharpening blade has a circular configuration.

6. A sharpening apparatus as set forth in claim 1 wherein said sharpening blade has a side surface which slopes away from said arcuate cutting edge in a direction toward a center of curvature of said arcuate cutting edge and toward the second end of said case.

7. A sharpening apparatus as set forth in claim 1 wherein the bottom of the slot slopes away from said arcuate cutting edge in a direction toward said first end of said case and toward a central axis of said cartridge, the skate blade being engagable with the bottom of the slot to orient the skate blade relative to said arcuate cutting edge.

8. A sharpening apparatus as set forth in claim 1 wherein said mounting portion of said base includes a recess having side surfaces which engage said first and second ends of said case.

9. A sharpening apparatus as set forth in claim 1 wherein said sharpening blade has a flat side surface which engages a flat positioning surface disposed in said case at a location between said first and second ends of said case.

10. A sharpening apparatus as set forth in claim 1 further including a plurality of fasteners which extend between said mounting portion and said case to connect said cartridge with said case.

11. A sharpening apparatus as set forth in claim 1 further including a recess extending into said case from said second end of said case, said sharpening blade being disposed in said recess.

12. A sharpening apparatus as set forth in claim 11 wherein said second end of said case includes a flat end surface, said recess having a flat bottom surface which is disposed in a plane extending transverse to a plane containing said flat end surface of said case.

13. A sharpening apparatus as set forth in claim 12 wherein said sharpening blade includes a flat major side surface which is disposed in engagement with said flat bottom surface of said recess.

14. A sharpening apparatus as set forth in claim 13 wherein said flat major side surface of said sharpening blade has a circular configuration and said flat bottom surface of said recess has a circular configuration.

15. A sharpening apparatus for use in sharpening a skate blade having a thickness and a radius of hollow, said sharpening apparatus comprising a base having mounting portion and a handle which extends from said mounting portion, a plurality of cartridges each of which is connectable with said mounting portion of said base, each of said cartridges of said plurality of cartridges includes a sharpening blade having an arcuate cutting edge with a radius of curvature which corresponds to a different skate blade radius of hollow of a plurality of radiuses of hollow, each of said cartridges of said plurality of cartridges at least partially defining a slot which has a width which corresponds to a different skate blade thickness of a plurality of thicknesses, said arcuate cutting edge of said sharpening blade of each cartridge of said plurality of cartridges extends across a bottom of the slot in one of said cartridges of said plurality of cartridges, and a fastener for connecting a selected cartridge of said plurality of cartridges with said mounting portion of said base.

16. A sharpening apparatus as set forth in claim 15 wherein said handle extends longitudinally from said mounting portion and has a longitudinal axis which extends along said mounting portion.

17. A sharpening apparatus as set forth in claim 15 wherein each of said cartridges of said plurality of cartridges has a cylindrical configuration.

18. A sharpening apparatus as set forth in claim 15 wherein said sharpening blade in each cartridges of said plurality of cartridges has a circular configuration.

19. A sharpening apparatus as set forth in claim 15 wherein said sharpening blade in each cartridge of said plurality of cartridges has a side surface which slopes away from said arcuate cutting edge in a direction toward a center of curvature of said arcuate cutting edge.

20. A sharpening apparatus as set forth in claim 15 wherein said mounting portion of said base includes a recess having side surfaces which are engagable with opposite ends of a selected cartridge of said plurality of cartridges.

21. A sharpening apparatus for use in sharpening a skate blade having a thickness and a radius of hollow, said sharpening apparatus comprising a handle, and a cartridge connected with said handle, said cartridge includes a sharpening blade having an arcuate cutting edge which is engagable with the skate blade, said sharpening blade having a side surface which slopes away from said arcuate cutting edge in a direction toward a center of curvature of said arcuate cutting edge and toward one end of said cartridge, said cartridge having a slot with opposite side surfaces which are engagable with opposite sides of the skate blade, said arcuate cutting edge extends across a bottom of the slot.

22. A sharpening apparatus as set forth in claim 21 wherein said sharpening blade has first and second major side surfaces, said arcuate cutting edge being formed at an intersection of said first major side surface and said side surface which slopes away from said arcuate cutting edge.

23. A sharpening apparatus as set forth in claim 22 wherein said first major side surface of said sharpening blade is disposed in flat abutting engagement with a positioning surface disposed within said cartridge.

24. A sharpening apparatus as set forth in claim 22 wherein said sharpening blade has a circular configuration.

25. A sharpening apparatus as set forth in claim 21 wherein said cartridge at least partially defines a recess in which said sharpening blade is disposed, said recess having a bottom surface which is engaged by said sharpening blade and is disposed between opposite ends of said cartridge.

26. A sharpening apparatus as set forth in claim 25 wherein said bottom surface of said recess is disposed in a plane extending transverse to a plane containing an end surface of said cartridge.

27. A sharpening apparatus as set forth in claim 26 wherein said sharpening blade has a central axis which extends perpendicular to a central axis of said bottom surface of said recess and is skewed at an acute angle to a central axis of said cartridge.

28. A sharpening apparatus as set forth in claim 21 wherein said bottom surface of said recess and said sharpening blade both have circular configurations.

29. A sharpening apparatus as set forth in claim 21 wherein said cartridge has a cylindrical configuration and said sharpening blade has a circular configuration, said sharpening blade being disposed between opposite ends of said cartridge.

30. A sharpening apparatus as set forth in claim 21 wherein said circular sharpening blade has a central axis which is offset from a central axis of said cylindrical cartridge.

31. A sharpening apparatus as set forth in claim 21 wherein said arcuate cutting edge has a radius of curvature which corresponds to a desired radius of hollow of the skate blade.

32. A sharpening apparatus as set forth in claim 21 wherein the slot has a width which corresponds to the thickness of the skate blade.

33. A sharpening apparatus as set forth in claim 21 wherein said cartridge includes a casing which extends around a portion of said sharpening blade and a fastener which extends through said sharpening blade and secures said sharpening blade to said casing.

34. A sharpening apparatus as set forth in claim 21 wherein the bottom of the slot slopes away from said cutting edge in a direction toward a central axis of said cartridge and toward said handle.

35. A sharpening apparatus for use in sharpening a skate blade having a thickness and a radius of hollow, said sharpening apparatus comprising a casing which is connectable with a handle, said casing having first and second end surfaces, said casing having a circular recess which extends into said casing from said second end surface of said casing, said recess having a flat circular end surface, a circular sharpening blade disposed in said recess in engagement with said flat circular end surface of said recess, said casing having slot with opposite side surfaces which are engagable with opposite sides of the skate blade, said sharpening blade having an arcuate cutting edge which extends across a bottom of the slot and is engagable with the skate blade when opposite side surfaces of the slot engage opposite sides of the skate blade.

36. A sharpening apparatus as set forth in claim 35 further including a fastener which extends through said sharpening blade and connects said sharpening blade to said casing.

37. A sharpening apparatus as set forth in claim 35 wherein the slot slopes away from said cutting edge toward a central axis of said casing and toward said first end surface of said casing.

38. A sharpening apparatus as set forth in claim 35 wherein said circular sharpening blade has a central axis which is offset from a central axis of said casing.

39. A sharpening apparatus as set forth in claim 35 wherein said arcuate cutting edge has a radius of curvature which corresponds to a desired radius of hollow of the skate blade and said slot in said casing has a width which corresponds to the thickness of the skate blade.

40. A sharpening apparatus as set forth in claim 35 wherein said casing has a cylindrical configuration.

41. A sharpening apparatus as set forth in claim 35 wherein said circular sharpening blade has a side surface which slopes away from said arcuate cutting edge in a direction toward a center of curvature of said arcuate cutting edge and away from said circular end surface of said recess.

42. A sharpening apparatus as set forth in claim 41 wherein said side surface of said circular cutting blade has configuration corresponding to the configuration of a portion of a cone.

43. A sharpening apparatus as set forth in claim 35 said circular flat end surface of said recess is disposed in a plane which extends transverse to a plane containing said second end surface of said casing.

44. A method of sharpening a skate blade having a thickness and a radius of hollow, said method comprising the steps of providing a plurality of sharpening cartridges each of which has a slot with a different width corresponding to a different thickness of skate blade, gauging the thickness of the skate blade with a gauge, selecting a sharpening cartridge having a slot with a width corresponding to the gauged width of the skate blade, connecting the selected sharpening cartridge with a handle, and sharpening the skate blade by providing relative movement between the skate blade and the selected sharpening cartridge with the skate blade disposed in the slot in the selected sharpening cartridge.

45. A sharpening apparatus for use in sharpening a skate blade, said apparatus comprising a longitudinally extending handle, a mounting portion connected to one end of said handle, a blade support connected to said mounting portion, and a sharpening blade connected to said blade support, said blade support at least partially defines a slot having opposite side surfaces which are engagable with opposite sides of the skate blade when a portion of the skate blade is disposed in the slot, said sharpening blade having an arcuate cutting edge which extends across a bottom of the slot and is engagable with the skate blade when a portion of the skate blade is disposed in the slot.

46. A sharpening apparatus as set forth in claim 45 wherein said sharpening blade has first and second parallel major side surfaces and a minor side surface extending between said first and second major side surfaces, said arcuate cutting edge being at least partially formed at an intersection of said first major side surface and said minor side surface.

47. A sharpening apparatus as set forth in claim 46 wherein said minor side surface of said sharpening blade slopes away from said first major side surface of said sharpening blade in a direction toward a center of curvature of said arcuate cutting edge.

48. A sharpening apparatus as set forth in claim 45 wherein said blade support has a recess with a flat surface, said sharpening blade being disposed in said recess in engagement with said flat surface of said recess, said slot in said blade support intersects said recess in said blade support at a location adjacent to said arcuate cutting edge on said sharpening blade.

49. A sharpening apparatus as set forth in claim 45 wherein said blade support has a cylindrical configuration and said sharpening blade has a circular configuration, said sharpening blade being at least partially enclosed by said blade support.

50. A sharpening apparatus as set forth in claim 45 wherein the bottom of the slot in said blade support slopes away from said arcuate cutting edge in a direction toward a central axis of said blade support, the skate blade being engagable with the bottom of the slot to orient the skate blade relative to said arcuate cutting edge.

* * * * *